United States Patent [19]

Young et al.

[11] 4,294,049

[45] Oct. 13, 1981

[54] QUICK OPENING INTERNAL MANWAY FOR TOWERS

[75] Inventors: Dick K. Young; Kenneth E. Sumner, both of Littleton, Colo.

[73] Assignee: Marathon Oil Company, Findlay, Ohio

[21] Appl. No.: 117,159

[22] Filed: Jan. 31, 1980

Related U.S. Application Data

[63] Continuation of Ser. No. 6,604, Jan. 16, 1979, abandoned.

[51] Int. Cl.[3] ..... E02D 29/14

[52] U.S. Cl. ..... 52/20; 49/367; 49/369; 49/464; 49/465; 261/114 TC

[58] Field of Search ..... 261/114 R, 114 TC; 52/19–21, 72; 203/DIG. 22; 49/33, 366–369, 463–465; 220/241, 307, 355, 356

[56] References Cited

U.S. PATENT DOCUMENTS

| | | | |
|---|---|---|---|
| 11,227 | 7/1854 | Ingalls | 49/463 |
| 790,034 | 5/1905 | Davison | 49/465 |
| 795,687 | 10/1926 | Cameron | 49/465 |
| 909,111 | 1/1909 | Paulson | 49/464 |
| 1,044,383 | 11/1912 | Hatch | 49/463 |
| 1,350,306 | 8/1920 | Forshee et al. | 52/19 |
| 2,105,501 | 1/1938 | Parsons | 261/114 R |
| 2,174,989 | 10/1939 | Lyons | 52/19 |
| 3,798,848 | 3/1974 | Campagna | 52/20 |
| 4,120,919 | 10/1978 | McClain | 261/114 TC |
| 4,133,852 | 1/1979 | Di Nicolantonio et al. | 261/114 TC |

*Primary Examiner*—Gregory N. Clements
*Attorney, Agent, or Firm*—Jack L. Hummel

[57] ABSTRACT

A manway cover is formed using two like door panels made of lightweight, corrosion-resistant material which are hand operable from either side of the manway and can be installed without tools.

2 Claims, 2 Drawing Figures

QUICK OPENING INTERNAL MANWAY FOR TOWERS

This application is a continuation of Ser. No. 6,604, Jan. 16, 1979, abandoned.

BACKGROUND OF THE INVENTION

1. Field of the Invention

The present invention relates to manway covers in general and especially to a quick-opening, internal manway cover providing access to the various trays within refinery distillation towers.

2. Description of the Prior Art

A modicum of patented and unpatented literature has been published regarding various manway covers and means for securing them in the manway.

U.S. Pat. No. 2,105,501 teaches a bubble tray with a circular opening manway which is held in place by a formed lip, flange, and J-bolts with springs which may be opened without the use of tools. U.S. Pat. No. 2,332,243 teaches a method for fastening manway covers to distillation column trays by means of threaded bolts which may be removed from above or below the tray. U.S. Pat. No. 2,611,596 teaches securing a manway cover detachably to flanges of the tray by means of a plurality of clamps using a wrench.

Glitsch, Inc. of Dallas, Texas, manufactures a manway cover under the trademark name, "Minute-Manway" which is a one-piece, rectangular cover hinging in the middle with dogs located near the center of the cover and where the sides of the cover opposite the hinged center fit under lips which extend above and are affixed to the surface of the tray. The cover is positioned so that the ends will slide under the lips affixed to the tray when the hinged center moves into a closed position.

The present invention embodies a manway cover consisting of two similar panels which interlock with each other and with the manway edge to remain in place.

SUMMARY OF THE INVENTION

The present invention is a quick-opening manway cover, especially suited for but not limited to use in a refinery distillation column. It is made up preferably of two substantially identical and interchangeable panels. The handles are hand operable from either side of the manway and need only to be rotated up to 90° to engage or disengage the latches holding the panels in place. The panels each cover preferably only one half of the manway and are made of light-weight metal which allows easy removal or carrying between trays of a distillation column.

In the preferred embodiment of this invention, the manway cover can be installed without welding or drilling since the features which hold the cover in place are a part of the manway cover. Finally, the manway cover strongly resists being blown off the manway by the occasional upsets which occur during distillation processes. As designed, the manway can be fabricated outside the vessel, passed through the large nozzle of the vessel, and installed in place without additional work inside the vessel.

Figure 1:
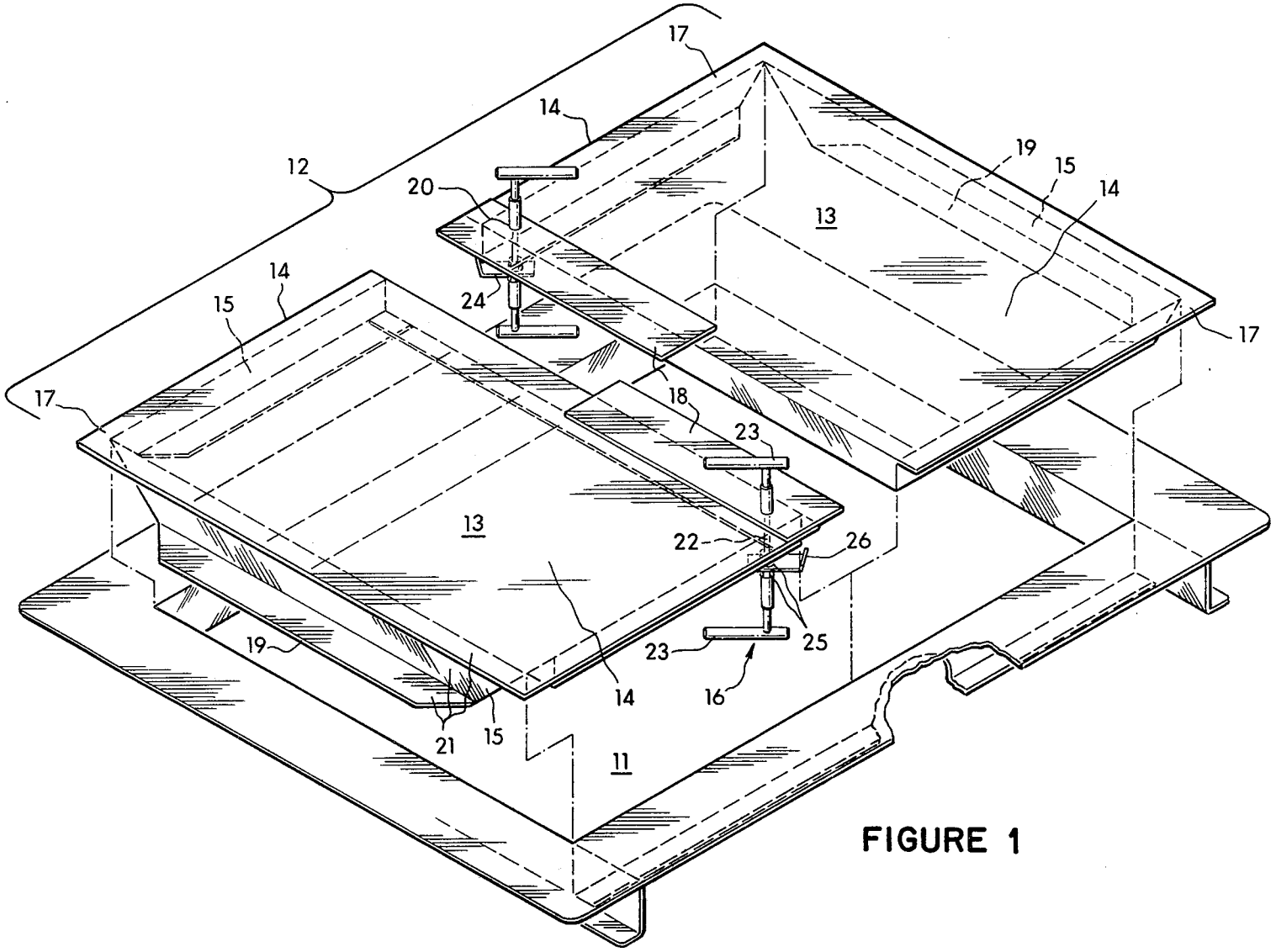
Figure 2:
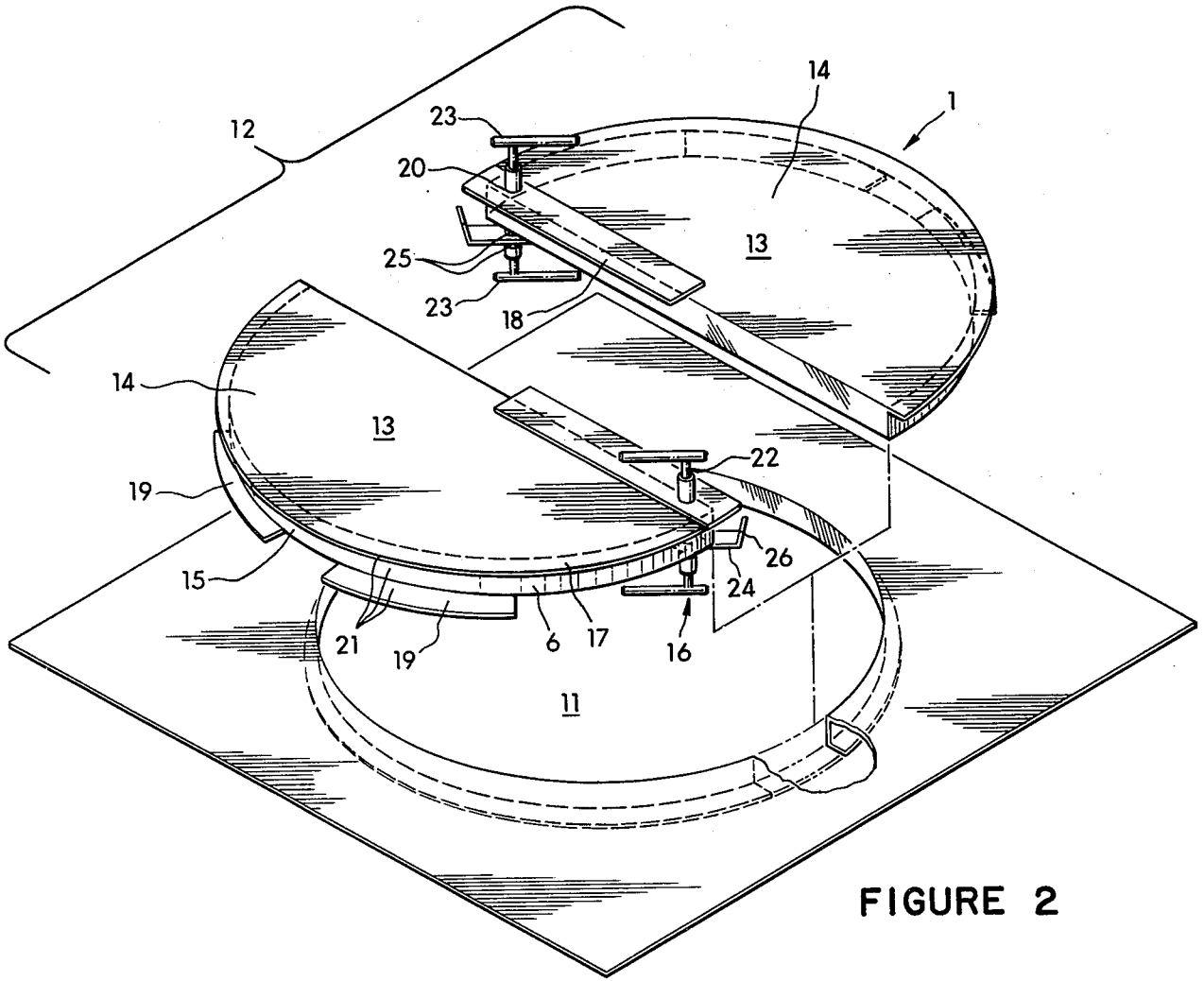

FIGS. 1 and 2 show specific embodiments of the invention.

PREFERRED EMBODIMENTS OF THE INVENTION

Manway cover 12 overlies at least a part of the edge of manway 11 and employs two like panels 13 which are usually rectangular (FIG. 1) but need not be (FIG. 2). The essential features of each panel are a cover 14, positioners 15, and a locking mechanism 16. Each panel 13 covers approximately one half of the manway; and the lip portion 17 overlies at least a part of the edge of manway 11.

A flange 18 on the top surface of cover 14 (as shown in the drawings) is positioned so that it overlies a portion of the top surface of the opposing panel 13 when both panels are in place. Preferably, it is spot welded to the cover.

Hereafter, when reference is made to cover 14, it will mean cover 14 exclusive of flange 18 unless specifically stated otherwise. In the preferred embodiment of this invention, cover 14 and positioners 15 are formed from a single piece of corrosion-resistant, light-weight-material, e.g. galvanized sheet metal, stainless steel, or aluminum.

Positioners 15 extend substantially perpendicularly from the panel bottom and are recessed from the edge of panel 13; however it is not necessary to recess positioner 15 on the side of a panel 13 which abuts another panel 13.

Flange 19 is located on positioners 15 opposite the side where the panels 13 abut. Flange 19 extends horizontally under the edge of manway 11 when panel 13 is in place. Preferably, this flange extends the entire length of positioner 15 on said side; however it may extend only partway, which is necessary in the circular manway cover embodiment (FIG. 2) since the panels will not slip into place if flanges 19 extend the length of positioner 15. Flange 19 is formed preferably from the same piece of material forming cover 14 and positioners 15 but may be welded in place.

Flange 19, positioners 15 to which it is attached, and lip 17 above flange 19 form outfacing reverse C channel 21.

Locking mechanism 16 is located near the corner of panel 13 where flange 18 overlies cover 14. Shaft 22 passes through suitable apertures (not shown) in flange 18, cover 14, and (in the preferred embodiment) a turned-under portion of positioner 15. Handles 23 and latch 24 may be attached to shaft 22 on both ends, which would enable manway cover 12 to be opened from either side. Latch 24 is attached directly below positioner 15 and near the center of shaft 22.

Latch 24 is affixed to shaft 22, in the preferred embodiment, by tightening nuts 25 on a threaded portion of shaft 22 against latch 24, although latch 24 could be welded to the shaft or affixed by any other suitable method. Latch 24 extends horizontally such that, by turning handles 23, latch 24 will engage the edge of manway 11, locking panels 13 in place. End 26 of latch 24 may be turned upwardly to hold the latch in the engaged position.

What is claimed is:

1. An improved quick opening internal manway cover for selectively opening and closing a manway, said manway having an edge disposed therearound, said improved manway cover comprising:

opposing identical panels for selectively opening and closing one-half of said manway, said panels being opposing and non-connected to each other when closed in said manway, each of said panels comprising:

(a) a cover piece for covering approximately one-half of said manway, said cover having means extending therefrom for overlying a portion of the top of said manway edge, (b) means extending downward from said cover piece for positioning said panel in said manway against said manway edge, (c) means connected to said positioning means on said cover piece opposite the side where said panel abuts the opposing panel for extending under said manway edge, (d) means connected to the top surface of said cover piece for overlying a portion of the top surface of the top of the cover piece of said opposing panel when said panels are in said closed position, and (e) means operatively connected through said cover piece near where the aforesaid overlying means is connected to said cover piece for releasably locking said panel to said manway edge when said panel is in said closed position, said locking means being capable of being operated from either side of said panel, and said improved cover being capable of being opened and closed on either side of said cover in said manway by operation of said locking means to fully release either one of said panels for removal and then by removing the remaining panel from said manway.

2. An improved quick-opening internal manway cover for selectively opening and closing a manway, said manway having an edge disposed therearound, said improved manway cover comprising:

opposing identical panels for selectively opening and closing one-half of said manway, said panels being opposing and non-connected to each other when installed in said manway, each of said panels comprising:

(a) a cover for covering approximately one-half of said manway, said cover having extending lip portions only on those edges of said cover next to said manway when said panel is in a closed position, said lip portions overlying a portion of the top of said manway edge, (b) positioner pieces extending substantially perpendicularly downward around said cover piece and recessed behind said lip portions, said positioner pieces being capable of positioning said panel in said one-half of said manway, (c) a flange outwardly extending from the positioner piece located on said cover piece opposite the side where said panel abuts the opposing panel; said flange, extending horizontally under said manway edge when said panel is in said closed position; said flange, the aforesaid positioner piece, and the lip portion directly above aforesaid positioner piece forming an outfacing reverse C-shaped channel, (d) a flange connected to the top surface of said cover piece overlying a portion of the top surface of the top of the cover piece of said opposing panel when said panels are in said closed position, and (e) means operatively connected through said cover piece near where the aforesaid flange is connected to said cover piece for releasably locking said panel to said manway edge when said panel is in said closed position, said locking means being capable of being operated from either side of said panel;

said improved cover being capable of being opened and closed on either side of said cover in said manway by operation of only one of said locking means to fully release either one of said panels for removal and then by removing the remaining panel from said manway.

* * * * *